US007100321B2

(12) United States Patent
Holmberg

(10) Patent No.: US 7,100,321 B2
(45) **Date of Patent: *Sep. 5, 2006**

(54) RANGE FINDER

(76) Inventor: Larry Holmberg, P.O. Box 1199, Hayward, WI (US) 54843

( * ) Notice: Subject to any disclaimer, the term of this patent is extended or adjusted under 35 U.S.C. 154(b) by 0 days.

This patent is subject to a terminal disclaimer.

(21) Appl. No.: 11/018,960

(22) Filed: Dec. 21, 2004

(65) Prior Publication Data

US 2005/0115141 A1 Jun. 2, 2005

Related U.S. Application Data

(60) Division of application No. 10/804,372, filed on Mar. 19, 2004, now abandoned, which is a continuation of application No. 10/641,169, filed on Aug. 14, 2003, now Pat. No. 6,988,331, which is a continuation of application No. 10/090,333, filed on Mar. 4, 2002, now Pat. No. 6,615,531.

(51) Int. Cl.
*F41G 1/00* (2006.01)

(52) U.S. Cl. ..... 42/142; 42/119; 42/114; 33/245

(58) Field of Classification Search ..... 42/119, 42/142, 114, 117; 89/41.06, 41.17; 33/245, 33/246

See application file for complete search history.

(56) References Cited

U.S. PATENT DOCUMENTS

| | | | | |
|---|---|---|---|---|
| 2,101,479 | A | | 12/1937 | Schenk |
| 3,684,376 | A | | 8/1972 | Lessard |
| 3,782,822 | A | | 1/1974 | Spence |
| T101,001 | I4 | | 9/1981 | Shipp et al. |
| D268,910 | S | | 5/1983 | Shipp et al. |
| 4,531,052 | A | | 7/1985 | Moore |
| 4,617,741 | A | | 10/1986 | Bordeaux et al. |
| 4,730,190 | A | | 3/1988 | Win et al. |
| 4,753,528 | A | | 6/1988 | Hines et al. |
| 4,777,352 | A | | 10/1988 | Moore |
| 4,835,621 | A | | 5/1989 | Black |
| 4,910,717 | A | | 3/1990 | Terry |
| 4,939,863 | A | | 7/1990 | Alexander et al. |
| D313,361 | S | | 1/1991 | Robinson |
| 4,993,833 | A | * | 2/1991 | Lorey et al. ..... 356/252 |
| 5,026,158 | A | | 6/1991 | Golubic |
| 5,373,657 | A | | 12/1994 | Betz et al. |
| 5,479,712 | A | | 1/1996 | Hargrove et al. |
| D371,084 | S | | 6/1996 | Ogawa |
| 5,575,072 | A | | 11/1996 | Eldridge |
| D390,483 | S | | 2/1998 | Zykan et al. |
| 5,815,251 | A | | 9/1998 | Ebbets et al. |
| 5,859,693 | A | | 1/1999 | Dunne et al. |
| 5,926,260 | A | | 7/1999 | Dunne et al. |
| 5,949,529 | A | | 9/1999 | Dunne et al. |

(Continued)

FOREIGN PATENT DOCUMENTS

| | | |
|---|---|---|
| GB | 2 024 558 A | 1/1980 |

(Continued)

*Primary Examiner*—J. Woodrow Eldred
(74) *Attorney, Agent, or Firm*—Fogg & Associates, LLC; Scott V. Lundberg

(57) ABSTRACT

A range finder for hunting applications. In one embodiment, a method of using a range finder is disclosed. The method comprises coupling the range finder to a weapon having an associated scope. Positioning at least part of a display of the range finder in front of a select portion of the associated scope. Activating the range finder. Determining the distance to a target and displaying the distance to the target through optics of the scope.

15 Claims, 9 Drawing Sheets

U.S. PATENT DOCUMENTS

| | | | | |
|---|---|---|---|---|
| 5,973,315 | A * | 10/1999 | Saldana et al. | 250/214 VT |
| D421,229 | S | 2/2000 | Imai | |
| 6,070,355 | A | 6/2000 | Day | |
| 6,073,352 | A | 6/2000 | Zykan et al. | |
| D432,930 | S | 10/2000 | Sanoner | |
| 6,137,564 | A | 10/2000 | Schmidt et al. | |
| 6,154,971 | A | 12/2000 | Perkins | |
| 6,269,581 | B1 | 8/2001 | Groh | |
| D448,315 | S | 9/2001 | Ito | |
| 6,331,887 | B1 | 12/2001 | Shiraishi et al. | |
| 6,396,571 | B1 | 5/2002 | Ohtomo et al. | |
| 6,397,483 | B1 | 6/2002 | Perkins | |
| D460,367 | S | 7/2002 | Apothéloz et al. | |
| D460,368 | S | 7/2002 | Apothéloz et al. | |
| D460,369 | S | 7/2002 | Apothéloz et al. | |
| D472,826 | S | 4/2003 | Sanoner | |
| 6,615,531 | B1 | 9/2003 | Holmberg | |
| 6,624,881 | B1 | 9/2003 | Waibel et al. | |
| 6,693,702 | B1 | 2/2004 | Rogers | |
| 6,704,097 | B1 | 3/2004 | Waibel et al. | |
| 2002/0067475 | A1 | 6/2002 | Waibel et al. | |
| 2003/0163943 | A1 | 9/2003 | Holmberg | |
| 2004/0051865 | A1 | 3/2004 | Stierle et al. | |
| 2004/0079018 | A1 | 4/2004 | Holmberg | |
| 2004/0114129 | A1 | 6/2004 | Gogalla et al. | |
| 2004/0135991 | A1 | 7/2004 | Gogalla et al. | |
| 2004/0194364 | A1 | 10/2004 | Holmberg | |

FOREIGN PATENT DOCUMENTS

| | | |
|---|---|---|
| GB | 2 114 770 A | 8/1983 |
| WO | WO 90/12330 | 10/1990 |

* cited by examiner

RANGE FINDER

CROSS-REFERENCE TO RELATED APPLICATIONS

This application is a divisional application of U.S. application Ser. No. 10/804,372, filed Mar. 19, 2004 now abandoned and titled "RANGE FINDER", which is a continuation application of U.S. application Ser. No. 10/641,169, filed Aug. 14, 2003 now U.S. Pat. No. 6,988,331 and titled "RANGE FINDER," which is herein incorporated by reference. Further, U.S. application Ser. No. 10/641,169, filed Aug. 14, 2003 is a continuation application of U.S. application Ser. No. 10/090,333, now U.S. Pat. No. 6,615,531, filed Mar. 4, 2002 and titled "RANGE FINDER," which is herein incorporated by reference and claimed in priority.

TECHNICAL FIELD

The present invention relates generally to range finders and in particular range finders for hunting applications.

BACKGROUND

Range finders can be a useful tool when hunting for game. A ranger finder conveys the distance to an object (game target). This information is helpful to a hunter because it allows a hunter to determine if the target is beyond the range of a firearm or bow. Knowing the distance to a target also aids the hunter in the placement of the sight of the firearm or bow. For example, if the target is a great distance from a firearm, a hunter can raise the sight of the firearm over the target a select distance to compensate for the trajectory of a projectile (bullet) fired from the firearm. The distance found by the range finder can aid the hunter in determining how much the sight should be raised over the target.

Traditional range finders can be disruptive in a hunting situation. The hunter must operate the hunting weapon and the range finder at the same time. Moreover, telescopes incorporating range finder circuits are generally heavy, bulky and expensive to purchase.

For the reasons stated above and for other reasons stated below which will become apparent to those skilled in the art upon reading and understanding the present specification, there is a need in the art for an inexpensive range finder that is non-disruptive to operate in a hunting situation.

SUMMARY

The above-mentioned problems with range finders and other problems are addressed by the present invention and will be understood by reading and studying the following specification.

In one embodiment, a method of using a range finder is disclosed. The method comprises coupling the range finder to a weapon having an associated scope. Positioning at least part of a display of the range finder in front of a select portion of the associated scope. Activating the range finder. Determining the distance to a target and displaying the distance to the target through optics of the scope.

In another embodiment another method of operating a range finder is disclosed. The method comprises coupling the range finder to a counterweight bar of a bow. Aiming the range finder at a desired target. Activating the range finder. Determining the distance to the target and displaying the distance to the target on a display.

BRIEF DESCRIPTION OF THE DRAWINGS

The present invention can be more easily understood and further advantages and uses thereof more readily apparent, when considered in view of the description of the preferred embodiments and the following figures in which.

In accordance with common practice, the various described features are not drawn to scale but are drawn to emphasize specific features relevant to the present invention. Reference characters denote like elements throughout Figures and text.

DETAILED DESCRIPTION

In the following detailed description of the preferred embodiments, reference is made to the accompanying drawings, which form a part hereof, and in which is shown by way of illustration specific preferred embodiments in which the inventions may be practiced. These embodiments are described in sufficient detail to enable those skilled in the art to practice the invention, and it is to be understood that other embodiments may be utilized and that logical, mechanical and electrical changes may be made without departing from the spirit and scope of the present invention. The following detailed description is, therefore, not to be taken in a limiting sense, and the scope of the present invention is defined only by the claims and equivalents thereof.

Figure 1:
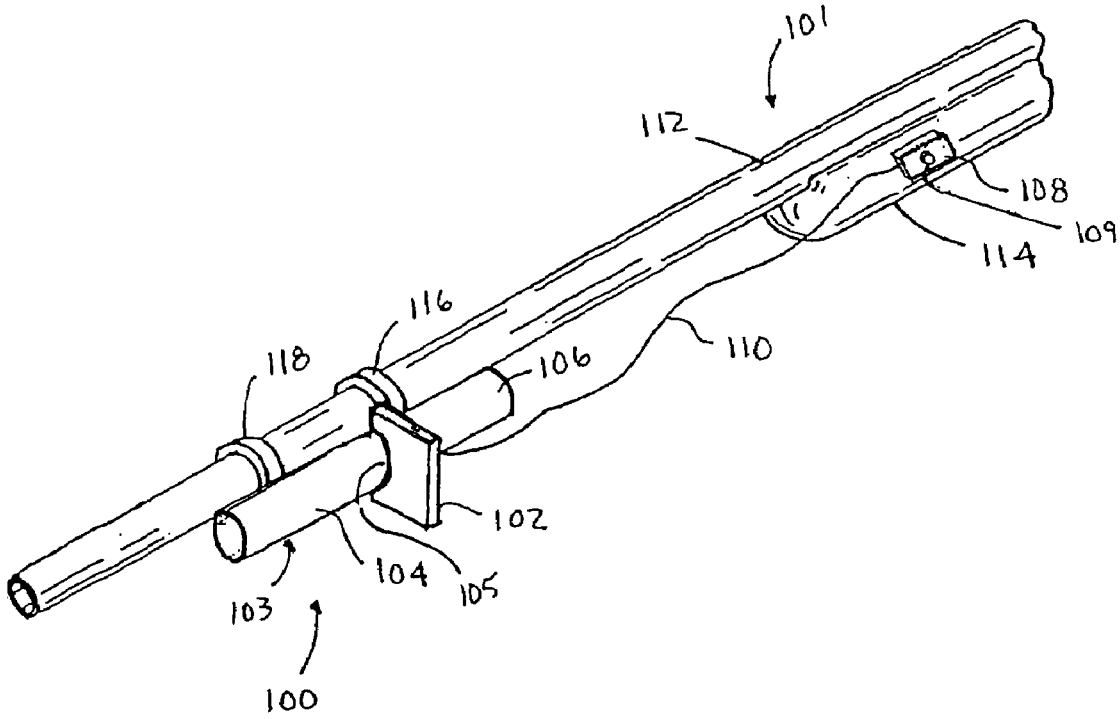
FIG. 1 is a side perspective view of one embodiment of the present invention coupled to a barrel of a firearm.

Embodiments of the present invention relate to range finder that is adapted to be mounted to a firearm. Referring to FIG. 1, a side perspective view of one embodiment of a range finder 100 coupled to a firearm 101 of the present invention is illustrated. As illustrated, the range finder 100 is coupled to the barrel 112 of the firearm 101 with a first bracket 116 and a second bracket 118. The range finder 100 of this embodiment is illustrated as having a cylindrical main housing 103 and a display housing 102 that extends from a mid portion 105 of the main housing 103. Main housing 103 includes a circuit housing 104 and a weather cover 106. Also illustrated in FIG. 1, is remote unit 108. Remote unit 108 is selectively coupled to the forearm 114 of the firearm by an adhesive, a loop and hook fastener or the like. The remote control unit 108 has an activation button 109. When the activation button 109 is depressed, the range finder 100 is activated. The remote control unit 108, of the embodiment of FIG. 1, is electrically coupled to the range finder by attaching cord 110. In another embodiment, the remote control unit 108 is in wireless communication with the range finder 100.

Figure 2:
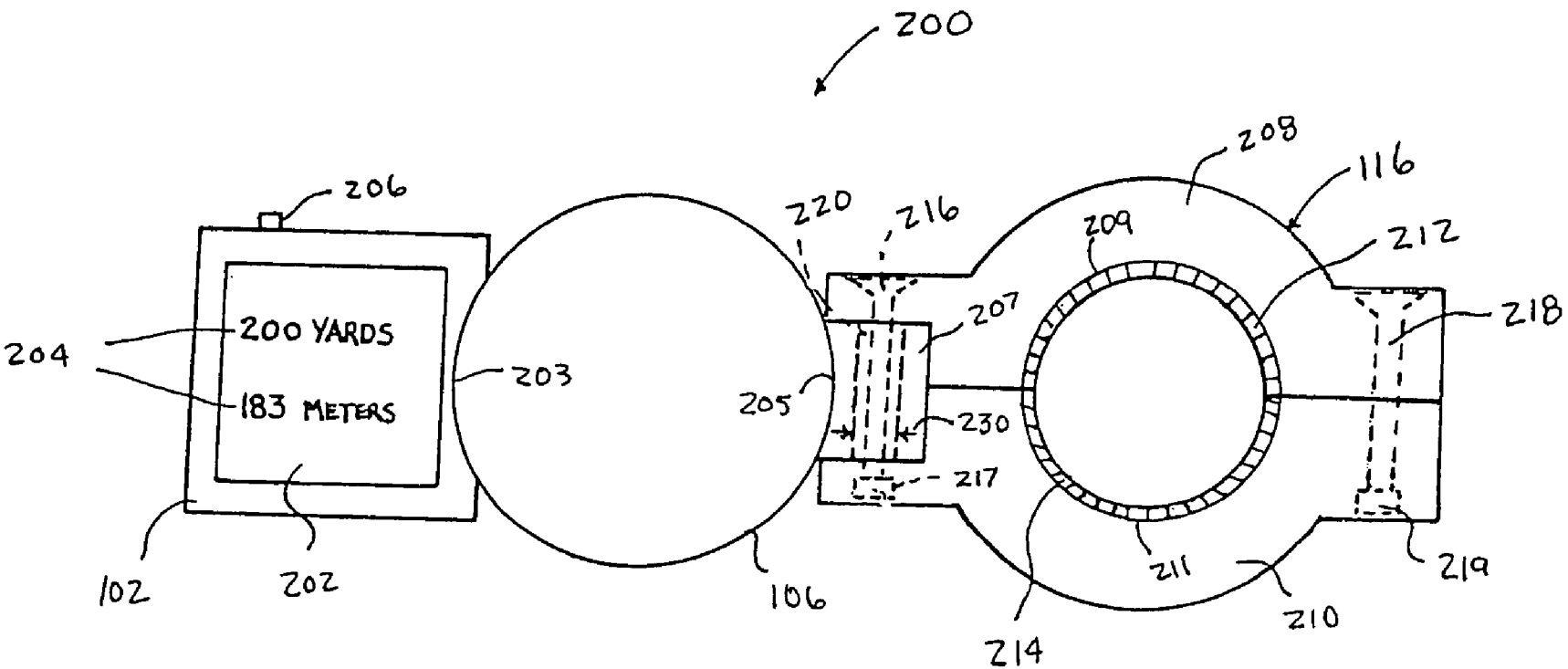
FIG. 2 is a rear view of one embodiment of the present invention.

A rear view of one embodiment of a range finder 200 of the present invention is illustrated in FIG. 2. As illustrated, a display 202 is encased in the display housing 102. The display may be a liquid crystal display or other type of display capable of conveying a message. When activated, the display 202 displays indicia 204 to convey the distance from the range finder 200 to an object it is pointed at. In the embodiment of FIG. 2, the indicia 204 conveys the distance in yards and meters. A brightness control 206 is mounted through the display housing 102 to control the brightness of the display 202.

Also illustrated in FIG. 2, is first bracket 116. As illustrated, the first bracket 116 includes a first bracket portion 208 and a second bracket portion 210. In this embodiment, the first bracket portion 208 fits over a barrel of a firearm and the second bracket portion 210 fits under the barrel of a firearm. The first bracket portion 208 and the second bracket portion 210 are coupled together by bolts 216 and 218. In particular, bolt 216 secures the first bracket portion 208 to the second bracket portion 210 with nut 217 and bolt 218 secures the first bracket portion 208 to the second bracket portion 210 with nut 219. In addition, bolt 216 passes through a connection flange 207 to secure the range finder 200 to the first bracket 116. As illustrated in FIG. 2, the display housing 102 extends from a first side 203 of the circuit housing 310 and the flange 207 extends from a second side 205 that is opposite the first side 203. Moreover, although not shown, the second bracket is constructed in the same manner to couple the range finder 200 to the barrel 112 of the firearm 101 at another location.

Further illustrated in FIG. 2, is a first protective material 212 positioned adjacent a first inner surface 209 of the first bracket portion 208 and a second protective material 214 positioned adjacent a second inner surface 211 of the second bracket portion 210. The first and second protective material 212 and 214 are used to protect the barrel 112 of the firearm 101. Moreover, in one embodiment, the first and second protective material 212 and 214 come in different thickness to accommodate different barrel diameters. The first and second protective material 212 and 214 are made from material such as foam rubber and the like.

Figure 3:
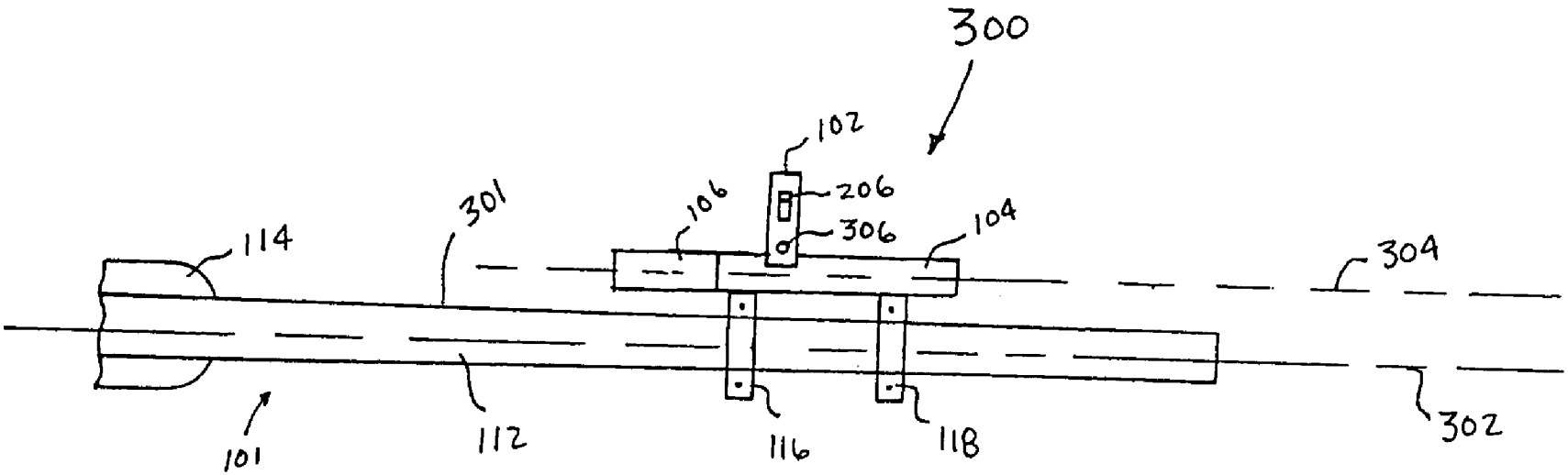
FIG. 3 is a top view of one embodiment of the present invention coupled to a barrel of a firearm.

Referring to FIG. 3, at top view of an embodiment of a range finder 300 of the present invention is illustrated. As illustrated, the range finder 300 is coupled so that it is positioned along a side 301 of the barrel 112 of the firearm 101. The positioning of the range finder 300 in this manner not only allows for a quick viewing of the distance by the hunter, it is also positioned so as to not interfere with the sight of the firearm. Embodiments, of the present invention can be mounted on either side of the barrel 112 of the firearm 101. Also illustrated in FIG. 3, is an on/off button 306 to turn on and off the range finder 300.

FIG. 3, further illustrates the barrel longitudinal axis 302 of the firearm. The barrel longitudinal axis 302 is the path of a bullet fired from the barrel 302. Further illustrated is a range finder longitudinal axis 304. The range finder longitudinal axis 304 is the path upon which the distance is determined. In the embodiments of the present invention, the range finder longitudinal axis 304 is adjusted to be generally parallel to the barrel longitudinal axis 302 so the distance of the bullet path is accurately determined by the range finder 300. Since some barrels 112 of firearms taper in diameter, a means of compensating to obtain parallel range finder and barrel longitudinal axis' 304 and 305 in needed.

Referring back to FIG. 2, one method of adjusting the position of the range finder 200 in relation to the barrel 112 to obtain parallel range finder and barrel longitudinal axis' is illustrated. The connection flange 207 has an adjusting aperture 220 with a lateral length 230 larger than the diameter of bolt 216 to allow the first bracket to be spaced at different distances from the range finder 200. In particular, bolt 216 passes through adjusting aperture 220 in coupling the first bracket to the range finder 200. Once a desired distance between the barrel of the firearm and the range finder 200 is achieved, nut 217 is tightened on bolt 216 thereby snugly coupling the first bracket 116 to the flange 207. Although not shown, the second bracket 118 is constructed in a similar manner to aid in aligning the range finder longitudinal axis 304 with the barrel longitudinal axis 302 of FIG. 3. In further another embodiment made for a specific barrel, the adjusting aperture 220 is placed in the flange 207 at a select position to obtain a desired distance between the first bracket 116 and the range finder 200.

Figure 4:
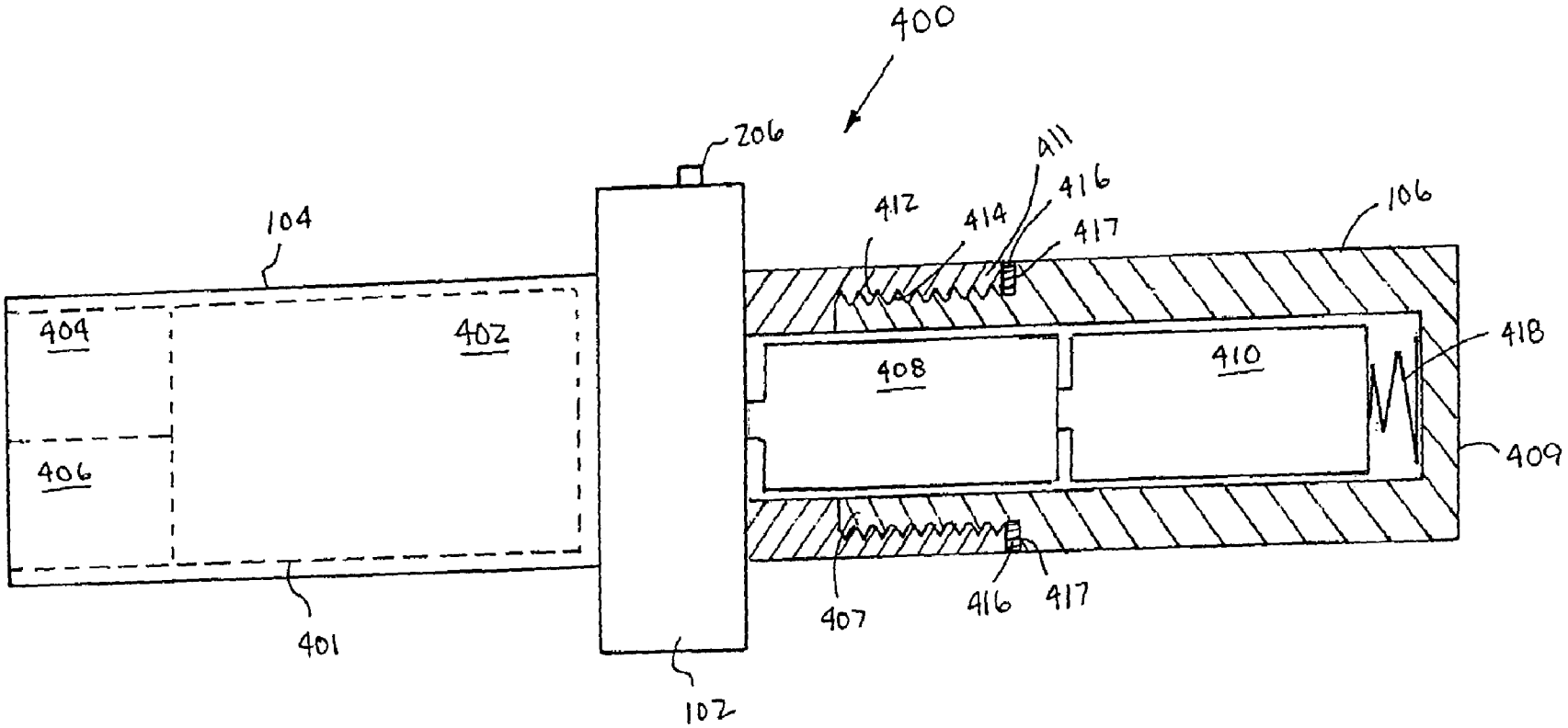
FIG. 4 is a side partial cut-out view of one embodiment of the present invention.

A side partial cross-sectional view of another range finder 400 embodiment of the present invention is illustrated in FIG. 4. The circuit housing 104 of the range finder 400 encases or houses the range finder circuit 401 that includes a range finder control circuit 402, a transmitter 404 and a receiver 406. The range finder control circuit 402 controls the range finding operations and is in electrical communication with the display 202, the transmitter 404 and the receiver 406. The transmitter 404 is used to transmit a laser signal and the receiver 406 is used to receive the signal after it has been reflected off a target (the object in which the distance to is to be determined). The range finder control circuit 402 then uses the transit time to determine the distance to the target. Once the distance has been determined, the range finder control 334, directs the display 202 to display the distance to the target. In the above-described embodiment, a range finder incorporating a light propagation time measuring method to determine the distance to an object is described. However, it will be understood in the art that other types of range finders could be used in the present invention such as the light-section method, the binocular sterosis method and the like, and the present invention is not limited to the light propagation time measuring method.

Also illustrated in FIG. 4, are power sources 408 and 410, which in this embodiment are batteries 408 and 410. The batteries 408 and 410 are housed in the weather cover 106 and are selectively coupled to supply power to the range finder control circuit 402, the transmitter 404, the receiver 406 and the display 202 when the weather cover is coupled to the circuit housing. A battery connection 418 is also shown. The weather cover 106 has a first end 407 and a second end 409. The second end 409 is enclosed. Moreover, the first end 407 of the weather cover 106 has external threads 412 that terminate in a shoulder 417. In addition, the circuit housing 104 has a first end 411 that has internal treads 414 that are adapted to threadably engage the external threads 412 of the weather cover 102. A seal 46 is positioned against the shoulder 417 so that when the external threads 412 of the weather cover 12 are threadably engaged with the internal threads 414 of the circuit housing 104 and tightened, the seal 417 is depressed against the shoulder 417 thereby creating a weatherproof seal. In addition, when the weather cover 106 is coupled to the circuit housing 104, the batteries 408 and 409 as well as other internal circuits are protected from weather like rain and snow. Moreover, when the weather cover 106 is not coupled to the circuit housing 104, a user has access to the batteries.

Figure 5:
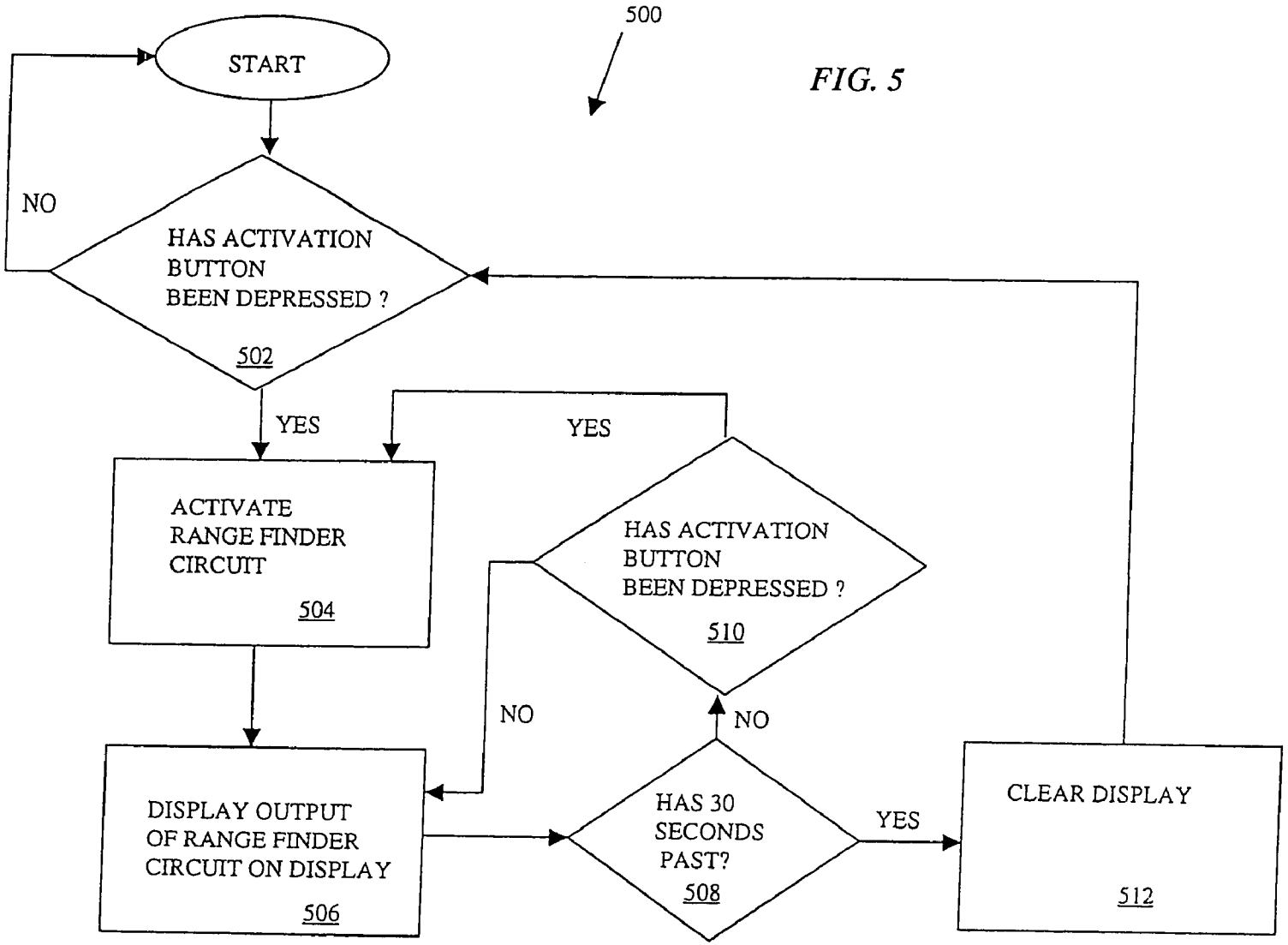
FIG. 5 is a flow chart illustrating the operation of one embodiment of the present invention.

A flow chart 500 illustrating one embodiment of the operation of the range finder control circuit 402 is illustrated in FIG. 5. Once, turned on, the range finder control circuit monitors the activation button 108 (502). Once, the activation button 108 is depressed, a range finder circuit 401 is activated to determine the distance to an object (504). The distance to the object is then displayed on display 202 (506). It is determined if 30 seconds has past since the distance was first displayed (508). If 30 seconds has not past, the activation button is monitored to see if it has been depressed (510). If it has not been depressed, the display continues to display the distance (506). If the activation button has been depressed, the range finder circuit is once again activated (504). If 30 seconds has past since the distance was first displayed, the display is cleared (512). The range finder control circuit 402 then monitors the activation button to see if it has been depressed (502). Although, this embodiment uses 30 seconds before clearing the display, other embodiments of the present invention use different selected times.

Figure 6:
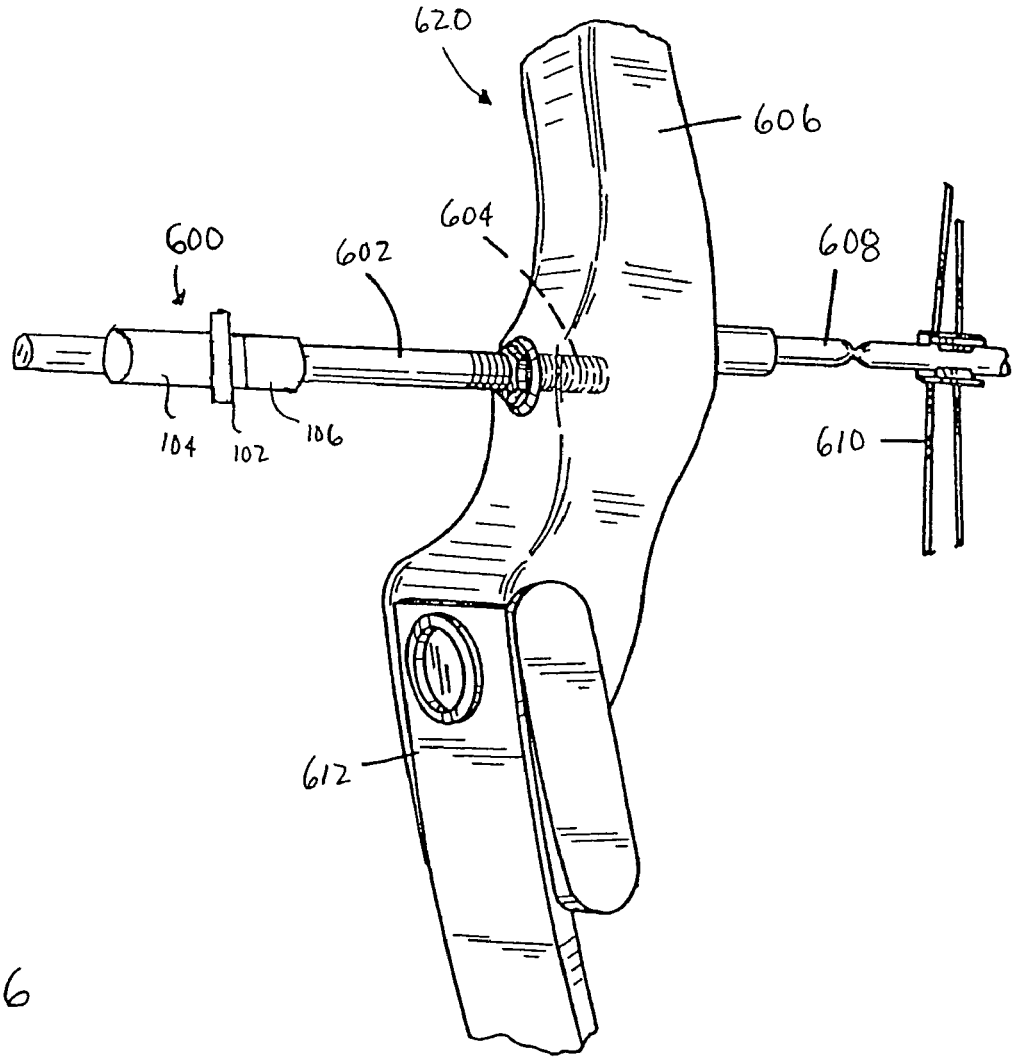
FIG. 6 is a side perspective view of one embodiment of the present invention coupled to a counterweight bar of a bow.

Another embodiment of a range finder 600 of present invention is illustrated in FIG. 6. In this embodiment, the range finder 600 is adapted to be mounted to a counterweight 602 of a bow 620. Since, the counterweight bar 602 is cylindrical in shape, like the barrel of the firearm, the method of attachment as illustrated in FIG. 2 is also applicable in this embodiment. The embodiment of FIG. 6, allows a bow hunter to use a range finder 600 in a fast and efficient manner without interfering with the hunt. The bow is illustrated as having a riser 606, a flexible bow element 612, a cable guard 608, bow string 610 and an internally threaded metal insert 604 that is adapted to receive external threads on the counterweight bar 602.

Figure 7:
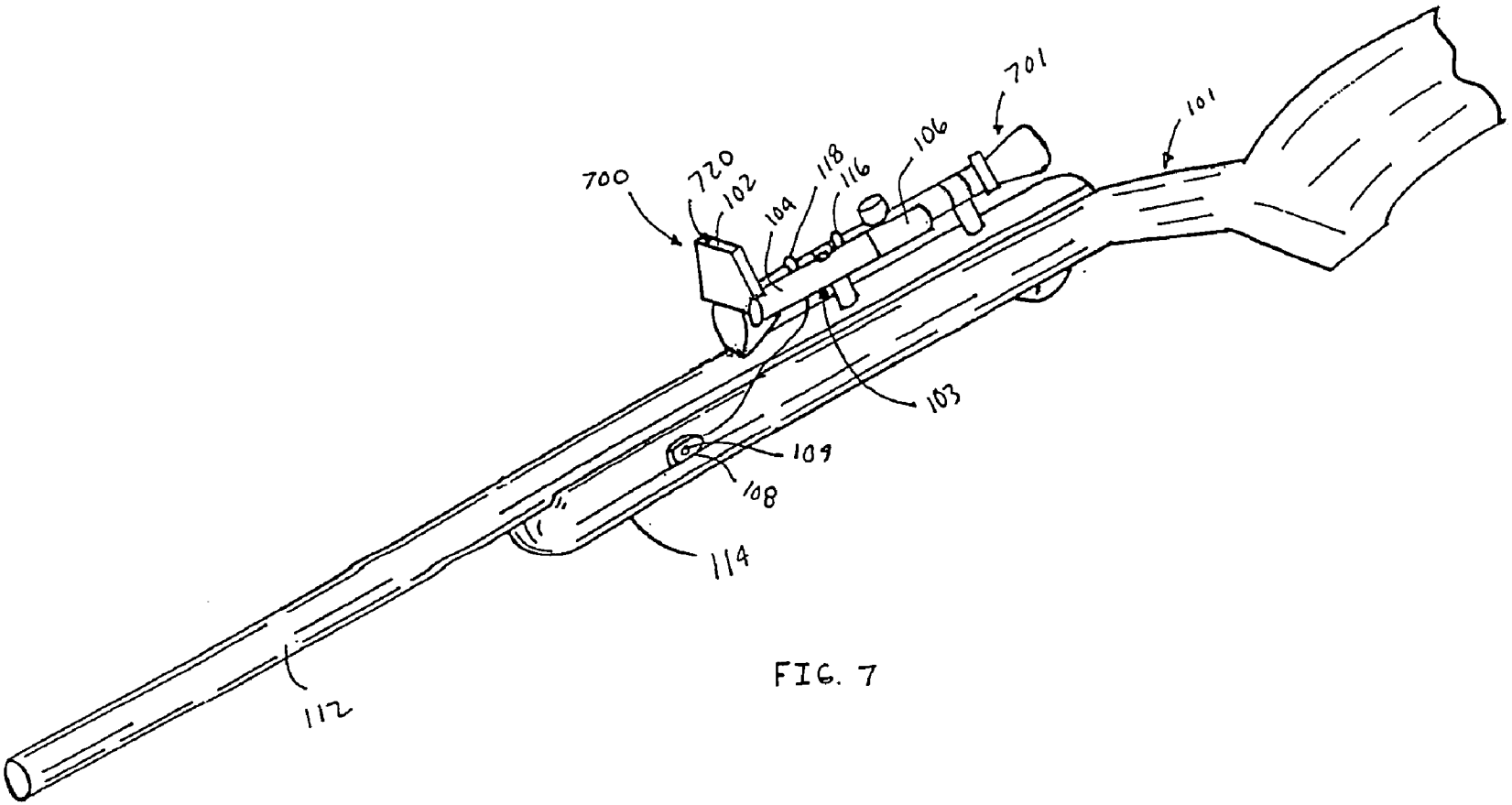
FIG. 7 is a side perspective view of another embodiment of the present invention coupled to a scope of a firearm.
Figure 8:
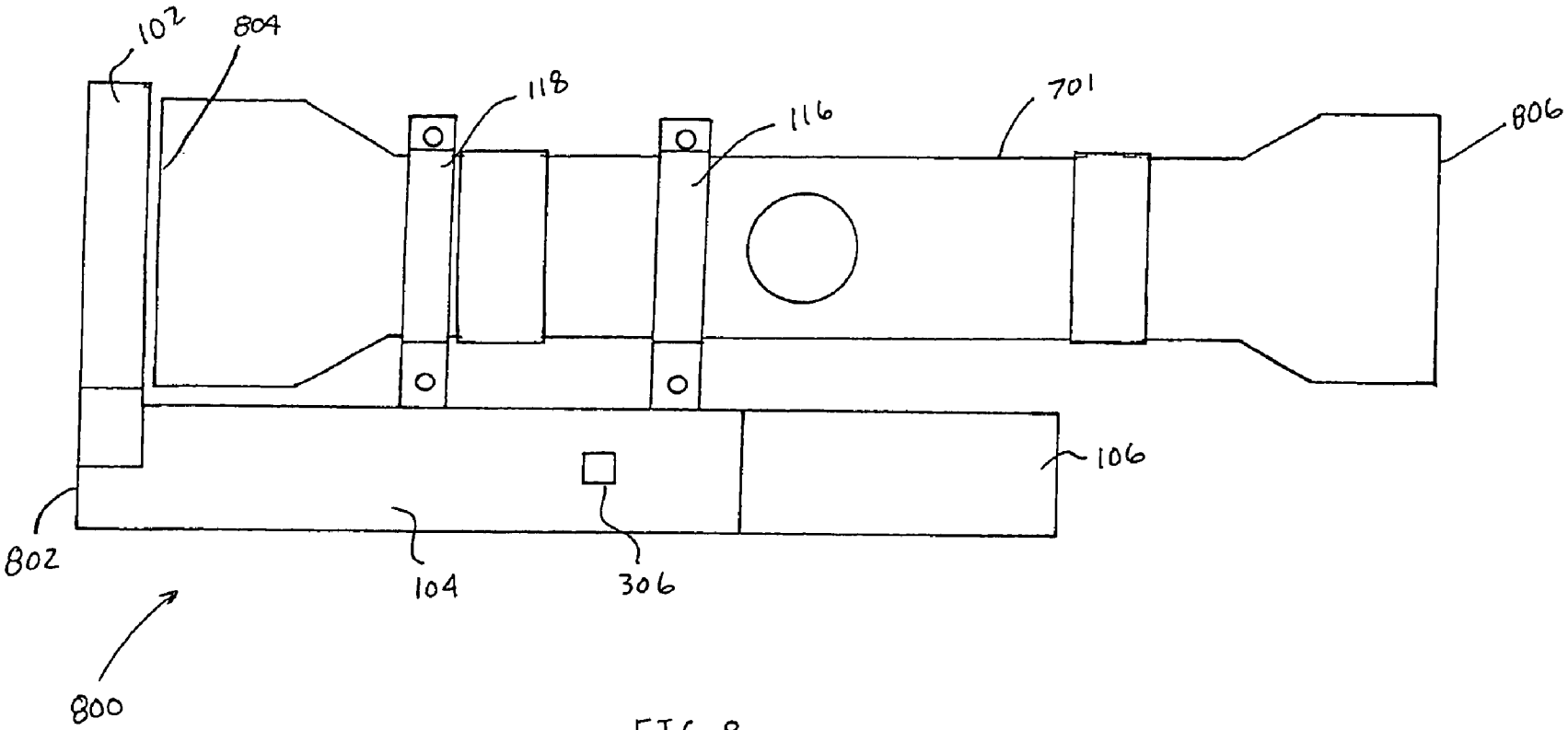
FIG. 8 is a top view of yet another embodiment of the present invention coupled to a scope of a firearm.

Referring to FIG. 7, yet another embodiment of the range finder 700 of the present invention is illustrated. As illustrated, this embodiment is adapted to be coupled to a scope 701 of a firearm 101. The range finder 700 is coupled to the scope with the first and second brackets 116 and 118 in the same manner the first and second brackets 116 and 118 couple the above-described range finder embodiments to the barrel 112 of firearm 101 and the counterweight bar 602 of bow 620. Also illustrated in FIG. 7 is remote control unit 108 and activation button 109 as is described in the embodiment of FIG. 1. The embodiment of FIG. 7, also includes a second activation button 720, wherein in this embodiment a user can either activate the range finder 700 by depressing activation button 109 or second activation button 720. Moreover, unlike the previous embodiments, in the embodiment of FIG. 7, the display housing 102 extends from a first end 802 of the circuit housing 104. This is further illustrated in the range finder 800 embodiment of FIG. 8. In this embodiment, the display housing 104 extends approximate a first end 804 of the scope 701. In fact, in this embodiment, the display housing 104 covers a portion of the first end 804 of the scope. FIG. 8 also illustrates the on/off button that is coupled to turn on and off the range finder 800 when depressed. Moreover, FIG. 8 further illustrates a second end 306 of the scope 701. The second end 806 of the scope 701 is the end in which a user looks through in sighting the scope on a target.

Figure 9:
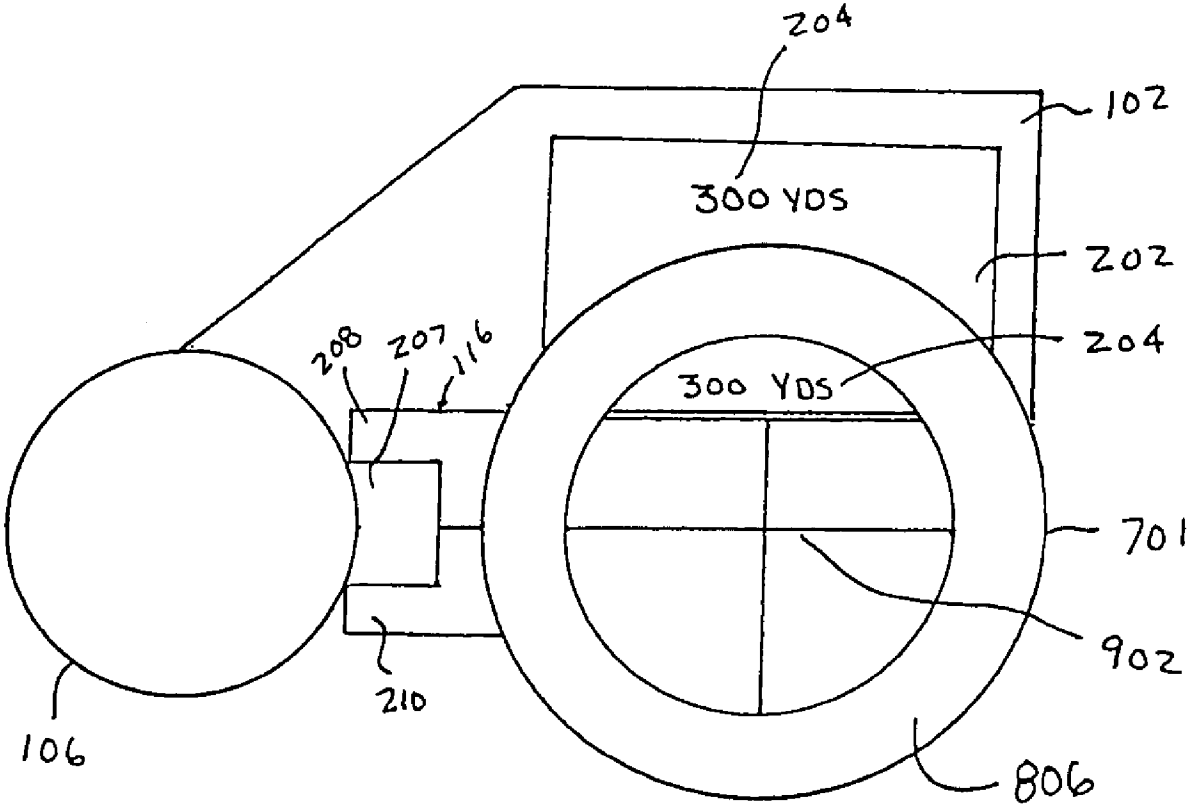
FIG. 9 is a rear view of yet another embodiment of the present invention coupled to a scope.

A rear view of one embodiment of a range finder 900 coupled to a scope 701 is illustrated in FIG. 9. As illustrated, the display 202 of this embodiment, uses indicia 204 to convey the distance the range finder 900 determines in two different locations. A first location of the display 202 with the indicia 204 is above the scope 701, so the user can determine distances without looking through the scope 701. A second location of the display 202 with the indicia 204 is in front of a portion of the scope so it can be viewed by looking through the second end of the scope 806. In this embodiment, the indicia 204, in the second display location, is optically adapted so the user can read the conveyed distance through the scope. Moreover, in this embodiment, the second location of the display 202 is positioned in front of an upper portion of the first end 804 of the scope 701 so the distance can be read above a sight 902 of the scope 701. Placing a portion of the display 202 in front of a portion of the first end 804 of the scope 701, allows the user the opportunity to view the distance and the sight 902 of the scope 701 at the same time thereby allowing the user the opportunity to read the distance without looking away from the sight 902.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

What is claimed is:

1. A range finder comprising:

a range finder circuit;

a display electrically connected to the range finder circuit; and a mounting structure to mount the range finder to a firearm such that a portion of the display is viewable through scope coupled to the firearm.

2. The range finder as in claim 1, further comprising:

a remote control unit in communication with the range finder control circuit to selectively activate the range finder.

3. The range finder of claim 2, wherein the remote control unit is coupled to a Forearm of the firearm.

4. The range finder of claim 2, wherein the remote control unit is coupled to the stock of a firearm.

5. A range finder comprising:

a range finder circuit;

a display electrically coupled to the range finder circuit, the display being adapted to be readable through scope coupled to a firearm; and a mounting structure to mount the range finder to the firearm.

6. The remote control as in claim 5, wherein the mounting structure is adapted to mount tile rangefinder to the scope of the firearm.

7. The range finder of claim 5, further comprising:

a remote control unit in communication with the range finder control circuit to selectively activate the range finder.

8. The remote control as in claim 7, wherein the remote control unit is coupled to the firearm.

9. A range finder comprising:

a range finder circuit;

a display electrically coupled to the range finder circuit;

the display positioned such that a displayed distance is readable through an existing scope; and a mounting structure adapted to mount the range finder to the scope.

10. The range finder of claim 9, further comprising:

a remote control unit in communication with the range finder control circuit to selectively activate the range finder.

11. The remote control of claim 10, wherein the remote control unit is coupled to the firearm.

12. A range finder comprising:

a range finder circuit;

a display electrically coupled to the range finder circuit;

the display positioned such that a displayed distance is readable through an existing scope mounted to a weapon; and a mounting structure to mount the range finder to a portion of the weapon.

13. The range finder of claim 12, wherein the portion of the weapon is the barrel of a firearm.

14. The range finder of claim 12, wherein the portion of the weapon is a scope.

15. The range finder of claim 12, wherein the portion of the weapon is the stock of a firearm.

* * * * *

UNITED STATES PATENT AND TRADEMARK OFFICE

CERTIFICATE OF CORRECTION

PATENT NO. : 7,100,321 B2
APPLICATION NO. : 11/018960
DATED : September 5, 2006
INVENTOR(S) : Larry Holmberg It is certified that error appears in the above-identified patent and that said Letters Patent is hereby corrected as shown below:

In the Claims

Col. 6, Line 14
Insert --a-- before "scope coupled"

Col. 6, Line 17
Delete "control" before "circuit"

Col. 6, Line 20
Delete "Forearm"
Insert --forearm--

Col. 6, Line 22
Delete "coupled to the stock of a firearm"
Insert --coupled to a stock of the firearm--

Col. 6, Line 26
Insert --a-- after "readable through"

Col. 6, Line 30
Delete "The remote control as in"
Insert --The range finder of--

Col. 6, Line 31
Delete "tile rangefinder"
Insert --the range finder--

Signed and Sealed this
Twenty-fourth Day of March, 2015

Michelle K. Lee

Michelle K. Lee
*Director of the United States Patent and Trademark Office*

Col. 6, Line 37
Delete “The remote control as in”
Insert --The range finder of--

Col. 6, Line 48
Delete “control” before “circuit”

Col. 6, Line 50
Delete “remote control” before “of claim 10”
Insert --range finder--

Col. 6, Line 65
Delete “the” before “stock of a firearm”
Insert --a--